US005735355A

United States Patent [19]

Bussod et al.

[11] Patent Number: 5,735,355

[45] Date of Patent: Apr. 7, 1998

[54] ROCK MELTING TOOL WITH ANNEALER SECTION

[75] Inventors: Gilles Y. Bussod, Santa Fe, N. Mex.; Aaron J. Dick, Oakland, Calif.; George E. Cort, Montrose, Colo.

[73] Assignee: The Regents of the University of California, Los Alamos, N. Mex.

[21] Appl. No.: 700,954

[22] Filed: Aug. 21, 1996

Related U.S. Application Data

[60] Provisional application No. 60/020,675, Jul. 1, 1996.

[51] Int. Cl.[6] ..... E21B 7/14; E21C 37/16

[52] U.S. Cl. ..... 175/11; 175/16; 299/14

[58] Field of Search ..... 175/11, 16; 299/14

[56] References Cited

U.S. PATENT DOCUMENTS 3,693,731 9/1972 Armstrong et al. ..... 175/11

5,168,940 12/1992 Foppe ..... 299/14 X

FOREIGN PATENT DOCUMENTS 1198179 12/1985 U.S.S.R. ..... 175/16

OTHER PUBLICATIONS

Magazaine Article, "Mineral Industry News" pp. 8.10. Jun. 1973.

*Primary Examiner*—David J. Bagnell

*Attorney, Agent, or Firm*—Ray G. Wilson

[57] ABSTRACT

A rock melting penetrator is provided with an afterbody that rapidly cools a molten geological structure formed around the melting tip of the penetrator to the glass transition temperature for the surrounding molten glass-like material. An annealing afterbody then cools the glass slowly from the glass transition temperature through the annealing temperature range to form a solid self-supporting glass casing. This allows thermally induced strains to relax by viscous deformations as the molten glass cools and prevents fracturing of the resulting glass liner. The quality of the glass lining is improved, along with its ability to provide a rigid impermeable casing in unstable rock formations.

7 Claims, 4 Drawing Sheets

ROCK MELTING TOOL WITH ANNEALER SECTION

This patent application claims the benefit under 35 USC §119(e) of U.S. provisional application, No. 60/020675 attorney docket no. S-82,604 filed Jul. 1, 1996.

BACKGROUND OF THE INVENTION

This invention relates to rock drilling and, more particularly, to the use of rock melting for forming boreholes. This invention was made with government support under Contract No. W-7405-ENG-36 awarded by the U.S. Department of Energy. The government has certain rights in the invention.

Rock melting is a promising drilling technology for stabilizing boreholes in unstable rock formations or in unconsolidated materials. The drilling system conventionally uses a penetrating bit of, e.g., molybdenum, electrically heated to 1,600° C. to melt a hole, typically two to three inches in diameter, as the penetrator advances. In porous minerals, the molten material is displaced around the sides of the penetrator, forming a glass-like lining that prevents hole collapse.

Rock melting drilling has application to many down-hole operations:

1. Geothermal industry—Rock melting is well suited for use in the high temperature environment associated with geothermal sites. The glass liner can serve to reduce or eliminate down-hole cementing and redrilling operations, particularly where conventional drilling has resulted in a stuck pipe or bit. A rock melting penetrator can melt through the blockage to complete a borehole.
2. Hydrocarbon industry—Borehole stability is a continuing problem, particularly for drilling in shale. The passage of fluids in boreholes and differential pressures can destabilize the geological structure forming the borehole with concomitant problems of borehole sealing and collapse. The ability to form an impermeable sheath to line the borehole can greatly reduce these problems.
3. Environmental remediation—Conventional drilling technologies can result in toxic environment impurities that have migrated to geologic formations, such as plutonium, becoming mobile as colloids in fluid suspensions. Rock melting drilling offers several advantages: (1) no fluid lubricants are involved that might cause cross-contamination; (2) the in-situ glass lining provides immediate borehole sealing and stabilization; (3) the process is most useful in porous consolidated or unconsolidated rocks, where the use of conventional methods is difficult; (4) the resulting glass sheath has a low thermal conductivity so that temperature gradients in the vicinity of the borehole are high and the surrounding rock substrate is affected by the rock melting within only about ten centimeters from the borehole.
4. Horizontal drilling—Horizontal directional drilling is being used increasingly by environmental engineers and the telecommunications industry to solve soil and ground water pollution problems and to route telecommunications fiber optic cables under existing structures. Most of these drilling environments involve porous and loosely consolidated materials in which rock melting drilling can produce linings in-situ during drilling to immediately stabilize the boreholes.

The mechanical integrity of the glass lining that is formed determines its ability to form a rigid impermeable glass casing in the borehole. Current glass forming afterbodies solidify the melt phase into a glass lining by quickly cooling the liquid from the penetrator tip temperature of about 1600° C. to the gas cooled temperature of 200° C. in approximately 10 minutes. This rapid quenching of the molten rock glass freezes thermally induced strains in the glass, which results in cracking of the glass lining.

The problem of glass quenching is recognized by the present invention and improved rock melting method and apparatus are provided for relaxing the strains induced in the glass lining during cooling of the glass.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a rock melting penetrator having a melting tip for heating a surrounding geological structure to a molten state and a cooling section for cooling the molten geological structure to a viscous state at a glass transition temperature for the molten geological structure. An annealing section cools the molten geological structure through an annealing temperature range below the glass transition temperature at a cooling rate effective to relax thermal strains in the molten geological structure as the molten state of the geological structure about the rock melting penetrator cools to form a glass lining.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In accordance with the present invention, a new afterbody design for a rock melting penetrator rapidly cools a molten geological structure formed around the melting tip of the penetrator to the glass transition temperature for the surrounding molten glass-like material. An annealing afterbody then cools the glass slowly from the glass transition temperature; through the annealing temperature range to form a solid self-supporting glass casing. This allows thermally induced strains to relax by viscous deformation as the molten glass cools and prevents fracturing of the resulting glass liner. The quality of the glass lining is improved, along with its ability to provide a rigid impermeable casing in unstable rock formations.

An annealing afterbody is a significant modification to conventional rock melting penetrator designs. Cooling rates of the glass lining that allow thermal strains to relax can be readily calculated from annealing schedules used by commercial glass manufacturers. The annealing afterbody is designed to cool the glass lining according to the calculated annealing schedule. A feedback temperature monitor system in the annealing afterbody may be used to accommodate variance in thermal properties for different rock types. The annealing afterbody may also contain heating elements for heat generation to compensate for heat loss to the parent rock and to the cooling gas used for the initial quench.

Figure 1:
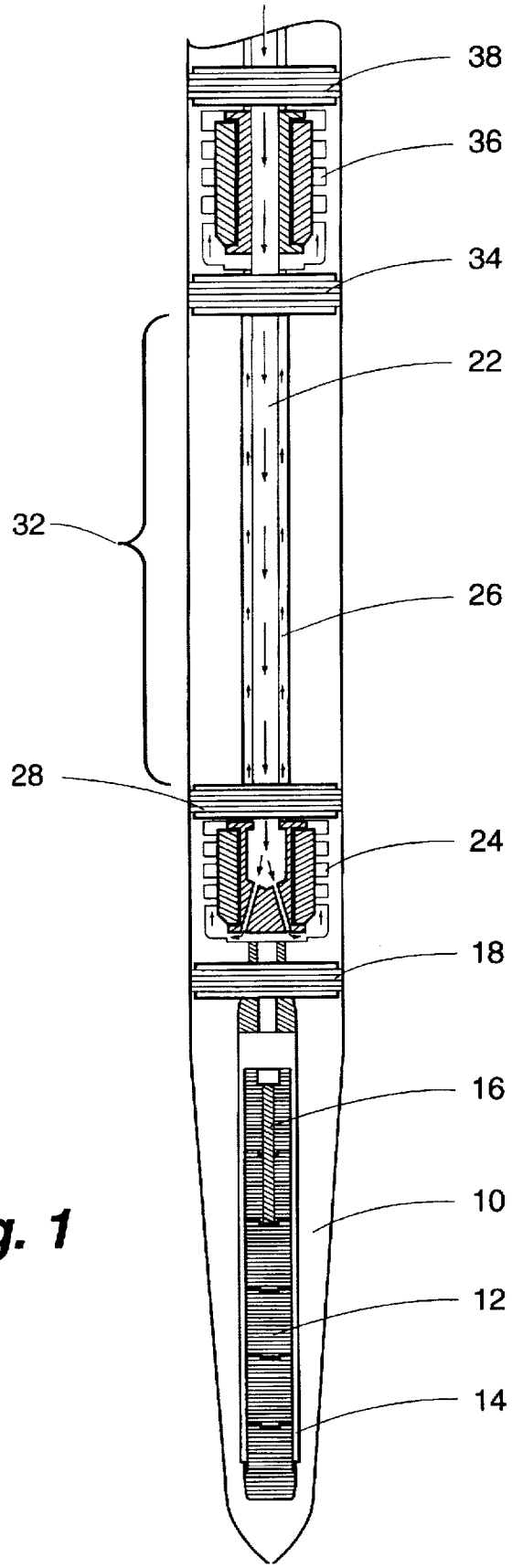
FIG. 1 is a rock melting penetrator with an annealing section in accordance with one embodiment of the present invention, shown in cut-away and partial cross-section.

Referring first to FIG. 1, there is shown a rock melting penetrator with an annealing section according to one embodiment of the present invention. Rock melting tip 10, is preferably constructed of molybdenum to withstand rock melting temperatures of, e.g., 1500°–1600° C. Melting tip 10 is heated by heat generated through resistance heating in heater 12 and transmitted through thermal receptor 14 surrounding heater 12. Heater 12 and receptor 14 may be constructed of a pyrolytic graphite that can withstand the necessary temperatures. Electrical current for heating heater 12 is delivered through electrical conductor 16. It will be understood that the design of melting tip 10 and associated internal heating elements is well known in the art and is not part of the present invention.

Cooling section 24 is located above melting tip 10 and is designed to cool the surrounding rock, which has been heated to a liquid state by melting tip 10, to a viscous state in an annealing temperature range, discussed below. As shown in FIG. 1, cooling section 24 is a coil that is thermally isolated from melting tip 10 by an insulator 18, which may be a pyrolytic graphite material. A cooling gas is supplied through inlet cooling gas pipe 22 and is circulated through cooling section 24. The heated cooling gas 22 is returned along return line 26. Another thermal insulator 34, which may be a pyrolytic graphite, isolates cooling section 24 from annealing section 32.

In accordance with the present invention, annealing section 32 enables the surrounding viscous melt to cool through the annealing temperature range at a rate that permits thermal strains in the cooling viscous liquid to relax. As the surrounding material cools to form a glass, the resulting glass is free or substantially free of thermal stress fractures that impair the integrity of prior art glass liners formed by rock melting.

In one embodiment of the present invention, a second cooling section 36 is thermally isolated by insulators 34 and 38 and receives a gas flow returning from cooling section 24 to further cool the surrounding material, which has cooled to a solid state. As shown, cooling section 36 is a coil design, but may be any conventional cooling section design for use in rock melting penetrators.

Figure 2A:
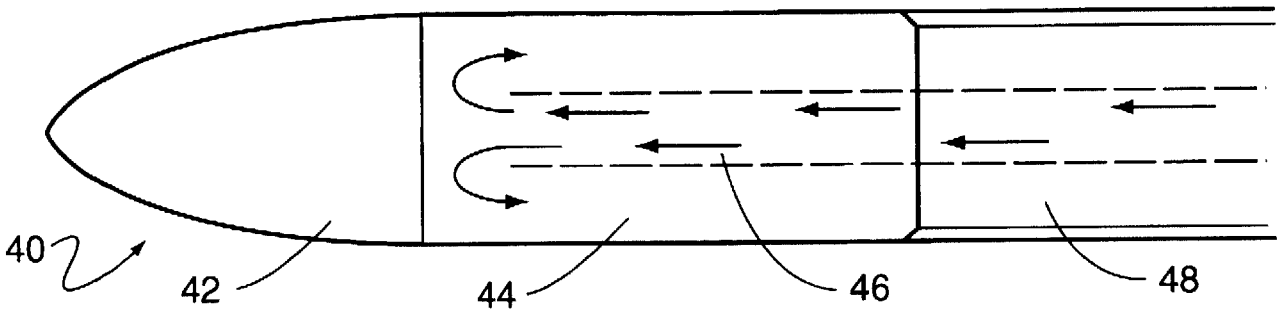
Fig. 2A (Prior Art)
FIGS. 2A and 2B are representations of a rock melting penetrator and temperature profile according to the prior art.
Figure 2B:
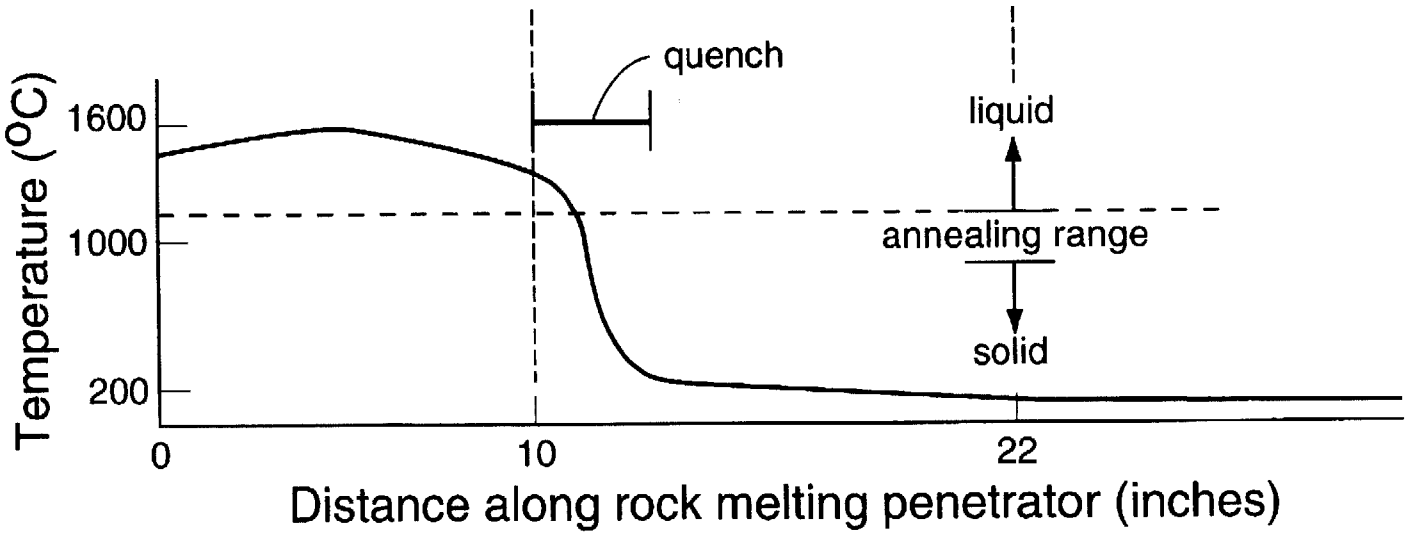
Fig. 2B (Prior Art)

FIGS. 2A and 2B depict a prior art rock melting penetrator 40 and an exemplary temperature profile resulting from the penetrator, respectively. Penetrator 40 includes melting tip 42, quenching after-body 44, cooling gas supply 46, and drill stem 48, which supports the penetrator. Cooling gas is circulated within after-body 44 to cool a surrounding molten rock to a solid state, i.e., to quench the molten rock. The resulting temperature profile along the axis of penetrator 42 is shown in FIG. 2B. The temperature adjacent melting tip 42 is in the range of 1600° C. in order to melt the surrounding structure. Cooling gas circulating in quenching after-body 44 quickly reduces the temperature in the molten rock to a temperature that solidifies the rock. The rapid quenching of the molten rock produces strains in the surrounding solidifying glass lining that are not relieved and the resulting thermal stress causes the solidified lining to stress fracture, with an attendant loss of integrity.

The behavior of "glassy" structures is well known. As rock is heated to a temperature above the "glass transition" temperature, the material becomes a viscous, amorphous material. As the molten rock is cooled below the glass transition temperature, the material again changes from an amorphous condition to hard, brittle condition. If the material is quenched, i.e., cooled rapidly through the glass transition temperature, thermal stresses are locked in the structure and give rise to stress fractures in the cooled, brittle material. On the other hand, if the material is cooled slowly, the thermal stress can be relieved by viscous deformation of the still-viscous material. Cooling rates that result in a solid structure with no substantial locked-in strains for various materials are well known. See, e.g., E. B. Shand et al., *Glass Engineering Handbook*, pp. 103–109, McGraw-Hill (1958).

Figure 3A:
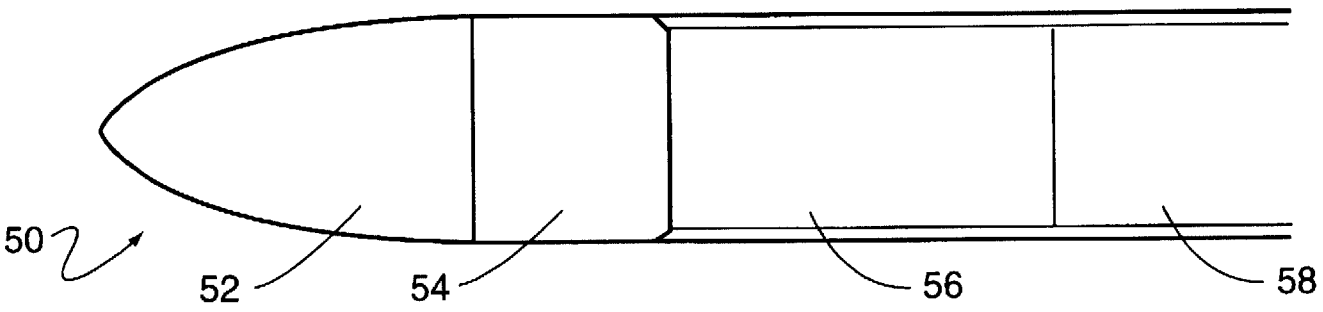
FIGS. 3A and 3B are representations of a rock melting penetrator and temperature profile according to the present invention.
Figure 3B:
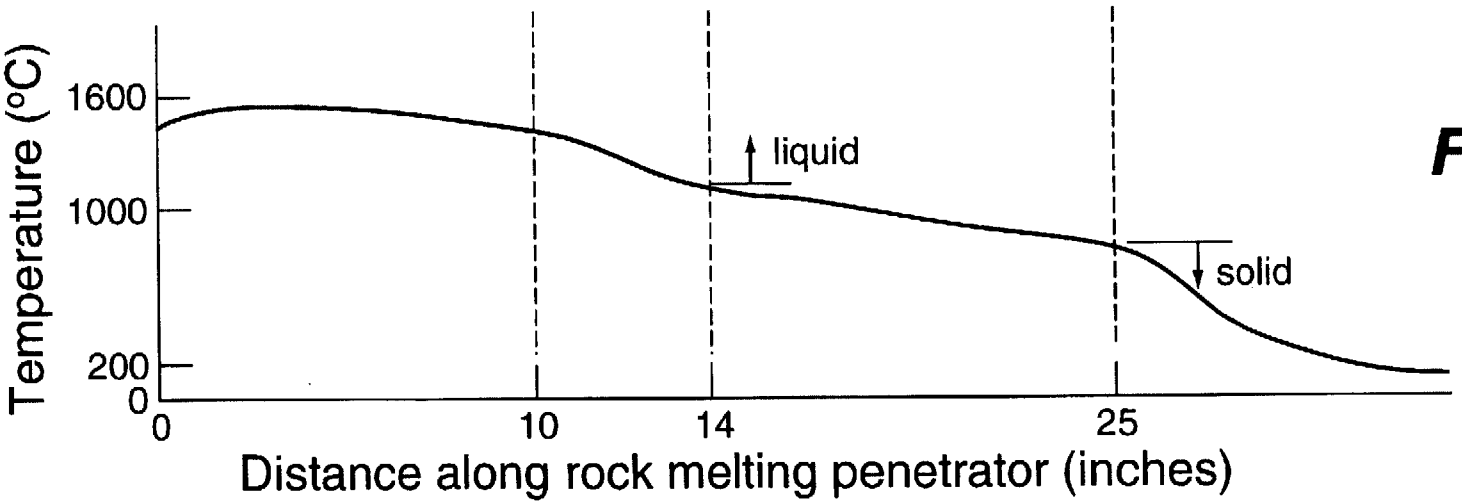
Figure 4:
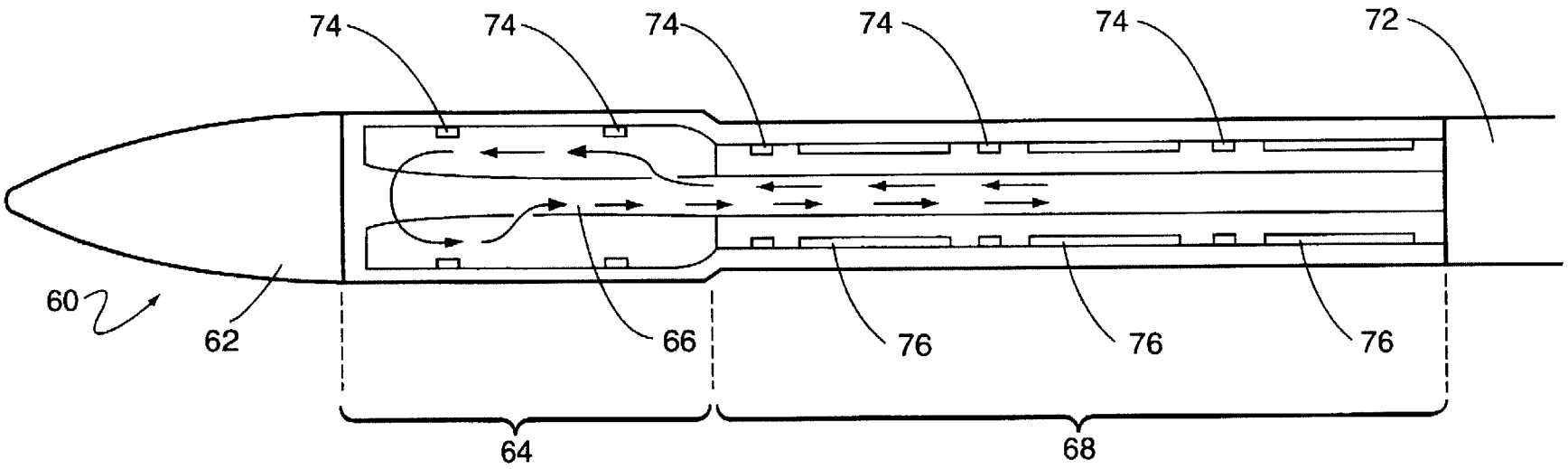
FIG. 4 is a cross-sectional representation of a rock melting penetrator according to one embodiment of the present invention.

The present invention recognizes the effect of cooling rate on the integrity of the resulting rock structure (hereinafter referred to as "glass") as the molten rock cools. FIGS. 3A and 3B depict a melting rock penetrator 50 and cooling profile, respectively, according to the present invention. Melting tip 52 again heats the rock structure above the glass transition temperature to a molten state. Cooling section 54 has a cooling gas supply (not shown) that reduces the temperature to about the glass transition temperature. Annealing section 56 is now included to slow the rate of cooling to a rate that enables the thermal stress to be relieved as the glass cools to a solid condition. Annealing section 56 may be a passive section, i.e., a section with little or no cooling, or contain heating elements as shown in FIG. 4 to produce a cooling rate compatible with stress relief. As shown in FIG. 3B, annealing section 56 reduces the cooling rate through the annealing temperature regime for stress relief to occur. Once the glass has solidified, the cooling rate may again be increased using a second cooling section (see FIG. 1) or may occur by conduction through the surrounding rock adjacent a drill stem 58.

FIG. 4 illustrates a second embodiment of a melting tip penetrator 60 according to the present invention. Again, melting tip 62 provides a temperature sufficient to melt adjacent rock. Cooling section 64 has a circulating gas flow 66 that is effective to cool the molten rock to the glass transition temperature and annealing section 68 provides a cooling rate that is effective to allow strains to be relieved in the cooling glass. As shown in FIG. 4, cooling section 64 and annealing section 68 are provided with temperature sensors 74, e.g., thermocouples or infra-red sensors, to monitor the cooling rate. Annealing section 68 includes heating elements 76 for use in further adjusting the glass cooling rate. Melting rock penetrator 60 is supported by drill stem 72. In this embodiment, the glass temperature and cooling rate can be monitored on external instruments (not shown) and the flow of cooling gas 66 and the temperature of heaters 76 can be adjusted to obtain the desired temperature profile. As discussed below, in a passive annealing section the length of the annealing section is determined from a predicted rock penetration rate and rock type, whereas the embodiment shown in FIG. 4 can accommodate a variety of changing conditions.

In one exemplary study, a rock melting penetrator was selected with a 2 inch diameter, forming a 0.5 inch thick glass liner, with a penetration rate of 0.5 m/hr (0.139 mm/s). The baseline rock properties were selected for basalt. An anneal time of 30 minutes was selected based on recommendations for commercial glass properties. The glass transition temperature for basalt is known to be 924K. The Fourier number, $\tau$, is a dimensionless number used in the study of unsteady-state heat transfer, equal to $D\ t/a^2$, where D is the rock thermal diffusivity; a is the melt layer thickness; and t is the time. The anneal study was based on the parameters in Table A, with t=1800 seconds.

TABLE A

| PARAMETER | UNITS | BASELINE | HIGH | LOW |
|---|---|---|---|---|
| a = glass thickness | mm | 12.5 | 25 | 6 |
| k = thermal conductivity | W/m K | 1.0 | 1.5 | 0.25 |
| D = thermal diffusivity | $m^2/s$ | 5.5 E-7 | 1.5 E-6 | 1.5 E-7 |
| V = penetration rate | m/hr | 0.5 | 2.0 | 0.1 |
| $\tau$ = Fourier No. | none | 6.336 | 75.0 | 0.432 |

The Fourier number is proportional to the time from the start of the transient and increases linearly as the annealing takes place. A representative time history of the temperatures in the glass is given by $$\theta = \tfrac{1}{2}[erf(X1) + erf(X2)] \qquad \text{Eq. (1)}$$

where $$\theta = [T(x,t) - T_\infty]/(T_O - T_\infty)$$

$$X1 = (1 - x/a)/(2\tau^{0.5})$$

$$X2 = (1 + x/a)/(2\tau^{0.5})$$

$$erf(X) = \frac{2}{\sqrt{\pi}}\ e^{-X^2}$$

For basalt rock, the cooling section cools the molten rock from the melt temperature, say 1850K, to the glass transition temperature, 924K. The cooling required for this temperature change is 133.4 W at a penetration rate of 0.15 mm/s The rock cools to 924K in 800 seconds for a 0.5 inch thick glass layer so that a cooling section length of 5 inches is adequate at a rock penetration rate of 0.15 mm/s. With circulating air as the cooling medium and a 2 inch diameter hole, the required maximum convective heat transfer film coefficient is 105 $W/m^2K$. This is achieved with air at a Reynolds number between 100,000 and 300,000. Note that the above analysis neglects cooling to the surrounding rock as well as thermal radiation heat transfer. The air flow can be readily adjusted to control the chill rate so that the melt is not cooled below the glass transition (anneal) temperature.

The anneal section then provides for maintaining the glass temperature within the anneal temperature range for a length of time to relieve thermal stresses. For basalt and a glass liner with the above parameters, this time is about 30 minutes. Heat conduction from the glass liner to the surrounding rock continues and this heat loss must be compensated by heaters in the anneal section (see FIG. 4). It will be appreciated that the surrounding rock is also heated by the melting tip penetrator. With a 10 inch long annealer section, and a penetration rate of 0.15 mm/s, an approximate heater power of 25–200 W is adequate to maintain the desired cooling rate. Then the maximum estimated thermal gradient in the basalt-glass 0.5 inch liner is only 10K and acceptable stress relief occurs.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A rock melting penetrator having a melting tip for heating a surrounding geological structure to a molten state comprising:

a cooling section for cooling said molten geological structure to a viscous state at a glass transition temperature for said molten geological structure; and an annealing section for cooling said molten geological structure through an annealing temperature range below said glass transition temperature at a cooling rate effective to relax thermal strains in said molten geological structure as said molten state of said geological structure about said rock melting penetrator cools to form a glass lining.

2. A rock melting penetrator according to claim 1, further including heaters attached to said annealing section for controlling said cooling rate.

3. A rock melting penetrator according to claim 2, wherein said cooling section further includes temperature sensors for outputting a signal related to the temperature of said molten geological structure for determining when said glass transition temperature is reached.

4. A rock melting penetrator according to claim 2, wherein said annealing section further includes temperature sensors that output a signal for determining the rate of cooling of said molten geological structure below said glass transition temperature.

5. A rock melting penetrator according to claim 1, wherein said cooling section further includes temperature sensors for outputting a signal related to the temperature of said molten geological structure for determining when said glass transition temperature is reached.

6. A rock melting penetrator according to claim 5, wherein said annealing section further includes temperature sensors that output a signal for determining the rate of cooling of said molten geological structure below said glass transition temperature.

7. A rock melting penetrator according to claim 1, wherein said annealing section further includes temperature sensors that output a signal for determining the rate of cooling of said molten geological structure below said glass transition temperature.

* * * * *